US005784891A

United States Patent [19]

Lee

[11] Patent Number: 5,784,891

[45] Date of Patent: Jul. 28, 1998

[54] ACTUATOR BUTTON FOR TEST SWITCH OF AN ICE MAKER

[75] Inventor: Gun Il Lee, Seoul, Rep. of Korea

[73] Assignee: Samsung Electronics Co., Ltd., Suwon, Rep. of Korea

[21] Appl. No.: 726,656

[22] Filed: Oct. 7, 1996

[30] Foreign Application Priority Data

Dec. 22, 1995 [KR] Rep. of Korea ..... 95-54789

[51] Int. Cl.[6] ..... F25B 49/00

[52] U.S. Cl. ..... 62/126; 200/333

[58] Field of Search ..... 62/125, 126; 200/333

[56] References Cited

U.S. PATENT DOCUMENTS

| | | | |
|---|---|---|---|
| 3,317,698 | 5/1967 | Mansfield | 200/333 |
| 3,932,721 | 1/1976 | Crowell et al. | 200/333 |
| 4,359,619 | 11/1982 | Bergoltz | 200/333 |
| 5,011,728 | 4/1991 | Imae et al. | 200/333 |
| 5,401,904 | 3/1995 | Greenier, Jr. | 200/333 |

*Primary Examiner*—William E. Tapolcai
*Attorney, Agent, or Firm*—Burns, Doane, Swecker & Mathis, L.L.P.

[57] ABSTRACT

A refrigerator includes a freezer compartment in which an ice maker is disposed. The ice maker includes an ice-making container and an operating mechanism for automatically twisting the container to cause ice to fall from the container. The operating mechanism includes a test switch that can be manually actuated to cause the operating mechanism to perform its functions. The test switch includes an electrical contact and a manually actuable button for activating the contact. The button is in the form of a strip formed of one piece with a wall of a case in which the contact is disposed. One end of the strip remains integral with the case wall to create an inherent bias for positioning a free end of the strip in spaced relationship to the contact, in the absence of a separate elastic spring element.

1 Claim, 8 Drawing Sheets

ACTUATOR BUTTON FOR TEST SWITCH OF AN ICE MAKER

FIELD OF THE INVENTION

The present invention is related to a refrigerator's ice maker, and more particularly, to a test switch of the ice maker which is used to verify the functions of the ice maker.

BACKGROUND OF THE INVENTION

A refrigerator having a conventional ice maker, shown in FIG. 5, is comprised of a freezing compartment 3 and a refrigerating compartment 4 separated by a partition 2 in its body 1. The compartments 3,4 are accessible by opening two doors 5,6 to the freezing compartment 3 and refrigerating compartment 4, respectively. Behind the freezing compartment 3 is provided a cooler or evaporator 7 which produces cold air. This cooled air is then forcedly circulated in the freezing compartment 3 and the refrigerating compartment 4 by a fan 8 installed in the upper portion of the cooler 7. To guide the flow of the cool air, a front plate 9 and a rear plate 10 are installed in front of and adjacent to the fan 8, respectively. In the front plate 9 is an outlet 11 which discharges the cool air into the freezing compartment 3, and at the rear plate 10 there originates a duct 12 supplying the cool air into the refrigerating compartment 4.

In the freezing compartment is an ice maker 20 which utilizes the cool air generated by the cooler 7 to turn water into ice. The ice maker 20 is comprised of an ice making container 21 having a plurality of concave portions 21' which hold the water as it freezes and an ice reservoir 22 which houses the ice cubes made in the ice making container 21. Further, in the refrigerating compartment 4 a water reservoir 23 and a water supply tank 24 are provided for furnishing water to the ice making container 21. A hose 25 extends from the water reservoir 23 to the upper portion of the ice making container 21. Through the hose 25 the water for the water reservoir 23 is fed to the ice making container 21. At the front of the ice making container 21 is provided an operating member 26 which drops the ice cubes from the ice making container 21 into the ice reservoir 22. It does this by twisting the ice making container 21 135° C. after the ice making mode has been completed. The ice maker 20 performs the water supply, the ice making mode and the ice dropping sequently. The conventional operating member 26 for performing the ice dropping mode is shown in FIG. 6. The operating member 26 is comprised of a motor 30 for generating a rotating force and a lever 45 and switch 46 which determine if the ice reservoir 22 is full.

In FIGS. 7 and 8, at the lower interior surface of a case 27 of the operating member a Print Circuit Board (P.C.B.) 50 for testing the operating member 26 and a contact member 60 for activating the P.C.B. are provided. The P.C.B 50 and the contact member 60 are utilized when a verifying try-out is carried out following the installation of the ice marker 20 or when a warranty try-out is performed after replacing an out-of-order component. In other words, in order to test the proper operation of the ice maker 20, when the contact member 60 is operated, the operating member turns on the motor 30 causing the ice making container 21 to twist. Next, in the water supply mode, the motor 24 is used to feed water into the empty ice making container 21. The sequence of these operations are verified by the operating member 26.

The P.C.B. 50 with the contact member 60 thereon is inserted into a bracket 55 formed adjacent to the case 27. An opening 57 is created in the case 27 which partially exposes the contact member 60. Into the opening 57 a button 65 for operating the contact member 60 is inserted. A bank 58, vertically extended inward from the inside surface of the case 27, is formed along the circumference of the opening 57. Thus, the center portion 66 of the button 65 is housed in the opening 57 and each end portion 67 rests on the bank 58. When the contact member is operated by the pushing of the button 65, the contact member 60 activates the operating member 26, thereby performing the ice cube dropping and the water supplying modes.

In the above described conventional test switch, the button 65 installed on the case 27 is operatably arranged using more components than necessary. In particular, a seperate elastic means (not shown) is unnecessarily provided as a discrete part for biasing the button away from the contact member.

The above described test switch is to be operated in the freezing compartment 3. Should the elastic means be eliminated from the test switch, altogether, the test switch could become stuck onto the case 27 due to frost generated in the freezing compartment 3, bringing about poor operation.

SUMMARY OF THE INVENTION

The present invention has been provided to solve the aforementioned problem and it is an objective of the present invention to provide a simplified test switch for a refrigerator's ice maker. It is another objective of the present invention to provide a test switch for a refrigerator's ice maker which enables the button to operate with inherent elasticity, thereby achieving a stable operation.

In order to obtain the objective of the present invention, the refrigerator comprises: a freezing compartment; an ice maker housed in the freezing compartment; the ice maker comprising an ice making container for turning water into ice by cold air convention and an operating member for rotating the ice making container which drops the ice into an ice reservoir; the operating member including a test switch for verifying each function of the operating member and the ice making container; the test switch including an electrical contact housed in the case of the operating member for operating the ice making container, and a button accommodated in the case and having an inherent bias to a position not touching the contact.

Further, the button comprises a strip partially cut from the case, and the base of the button is integrally anchored to the case. Additionally, the free end of the strip is thinner than that of the case.

DETAILED DESCRIPTION OF THE PREFERRED EMBODIMENT

Figure 1:
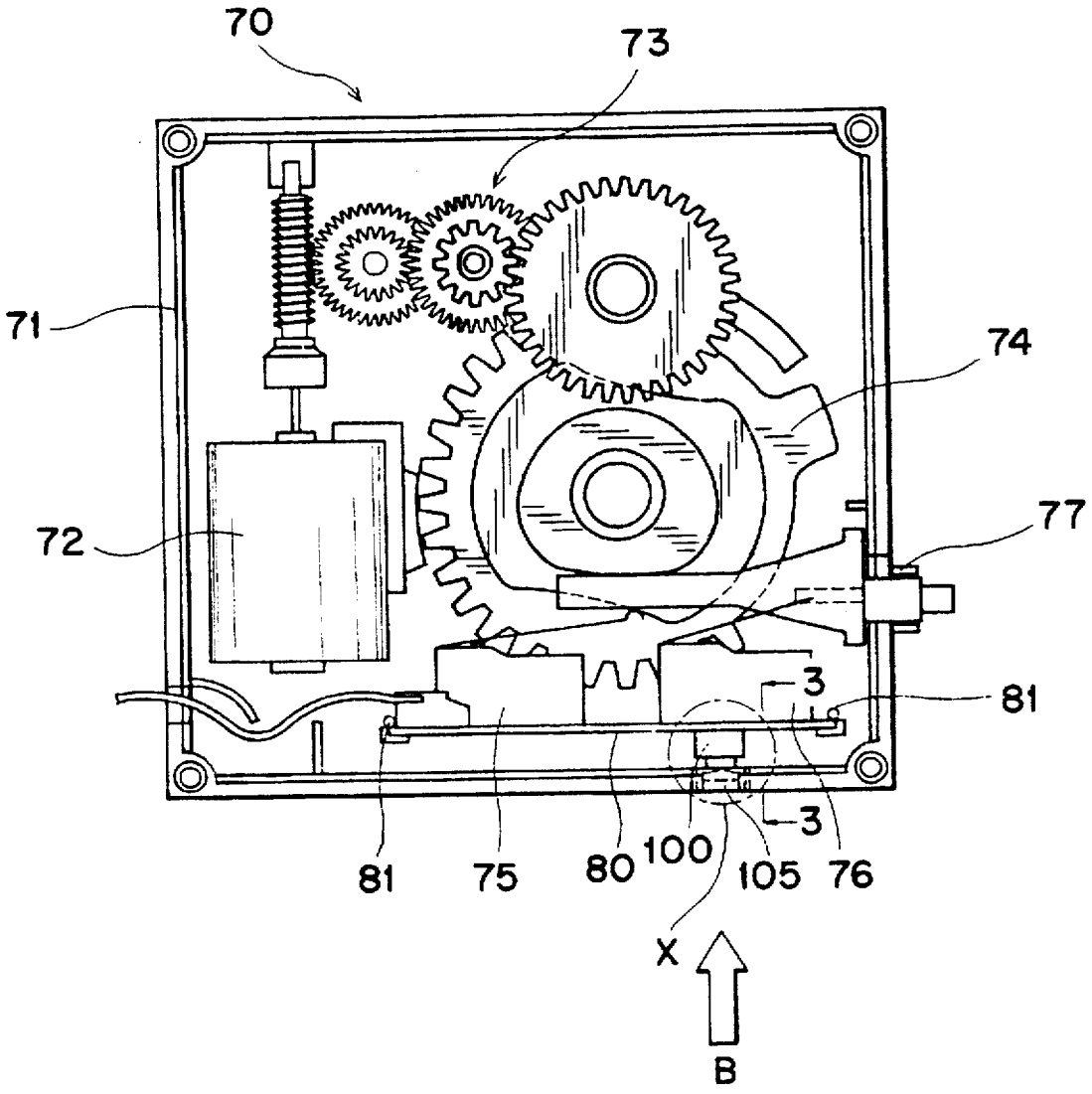
FIG. 1 is a front view of an ice maker's operating member, (with the cover removed), according to the present invention.

FIGS. 1 through 4 show a test switch of an operating member according to the present invention. The operating member 70 has the following components disposed in case 71: a motor 72, a reduction gear member 73 reducing the rotation speed output from the motor 72 and a cam gear 74 meshing with the reduction gear member 73 and connected by a shaft to the container 21 (Fig. 5) for twisting the container 21. Further, the operating member 70 is comprised of a pair of horizontal position sensing switches 75,76 which are operated by the rotation of the cam gear 74 and transmit a combined signal to the control member (not shown), and a lever 77 which is moved up and down depending on the quantity of ice cubes ice in the ice reservoir 22 so as to operate the switch 76. Furthermore, the case 71 houses a P.C.B. 80 with a contact member 100 thereon. The contact member 100 includes a projection 100A extending toward a wall 71A of the case 71. Both rear ends of the P.C.B. 80 are detachably inserted between a pair of brackets 81 formed on the inner surface of the case 71. The contact member 100 is attached to the lower surface of the P.C.B. and the horizontal sensing switches 75,76 lie on the upper surface of the P.C.B. 80.

Figure 2:
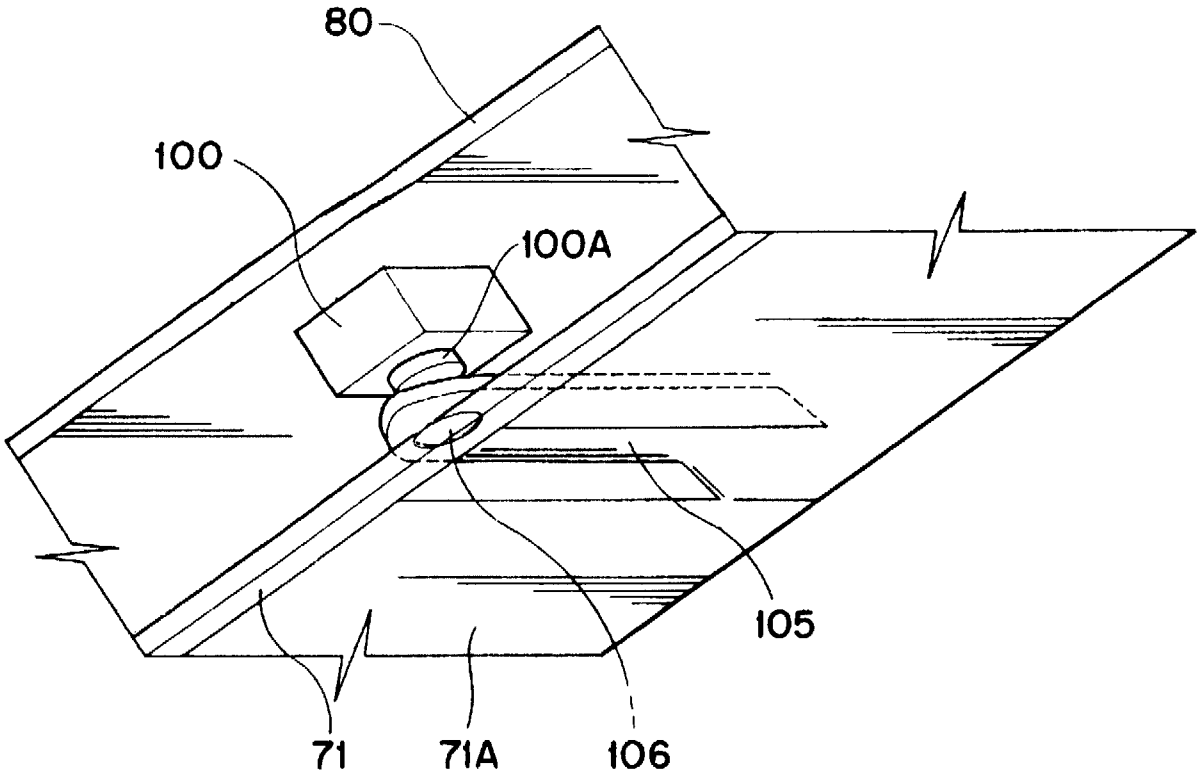
FIG. 2 is an enlarged perspective view showing the portion of FIG. 1 disposed in the circle X.
Figure 3:
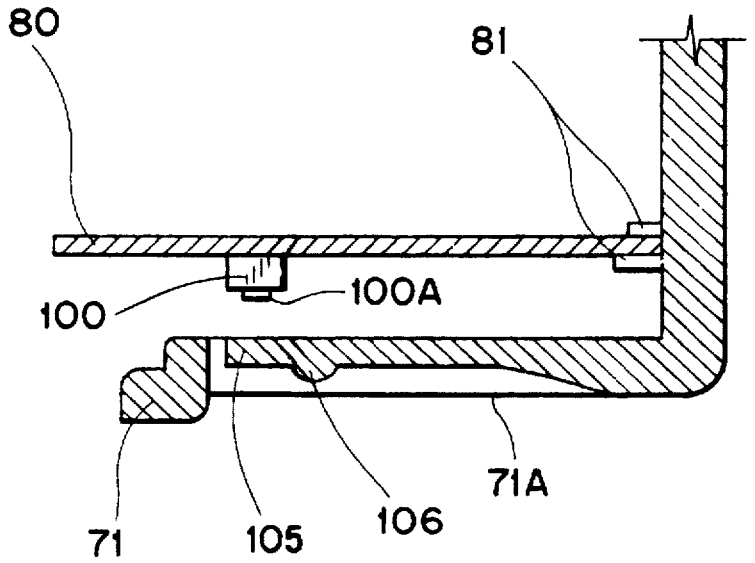
FIG. 3 is a vertical cross-sectional view taken along line 3—3 of FIG. 1.
Figure 4:
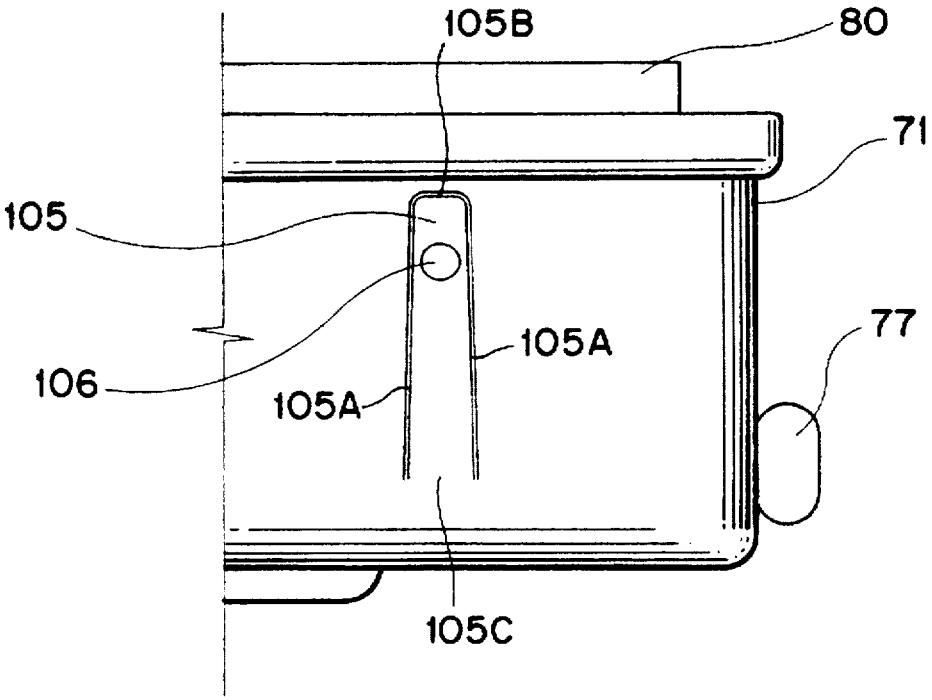
FIG. 4 is a bottom view taken in the direction of arrow B of FIG. 1.
Figure 5:
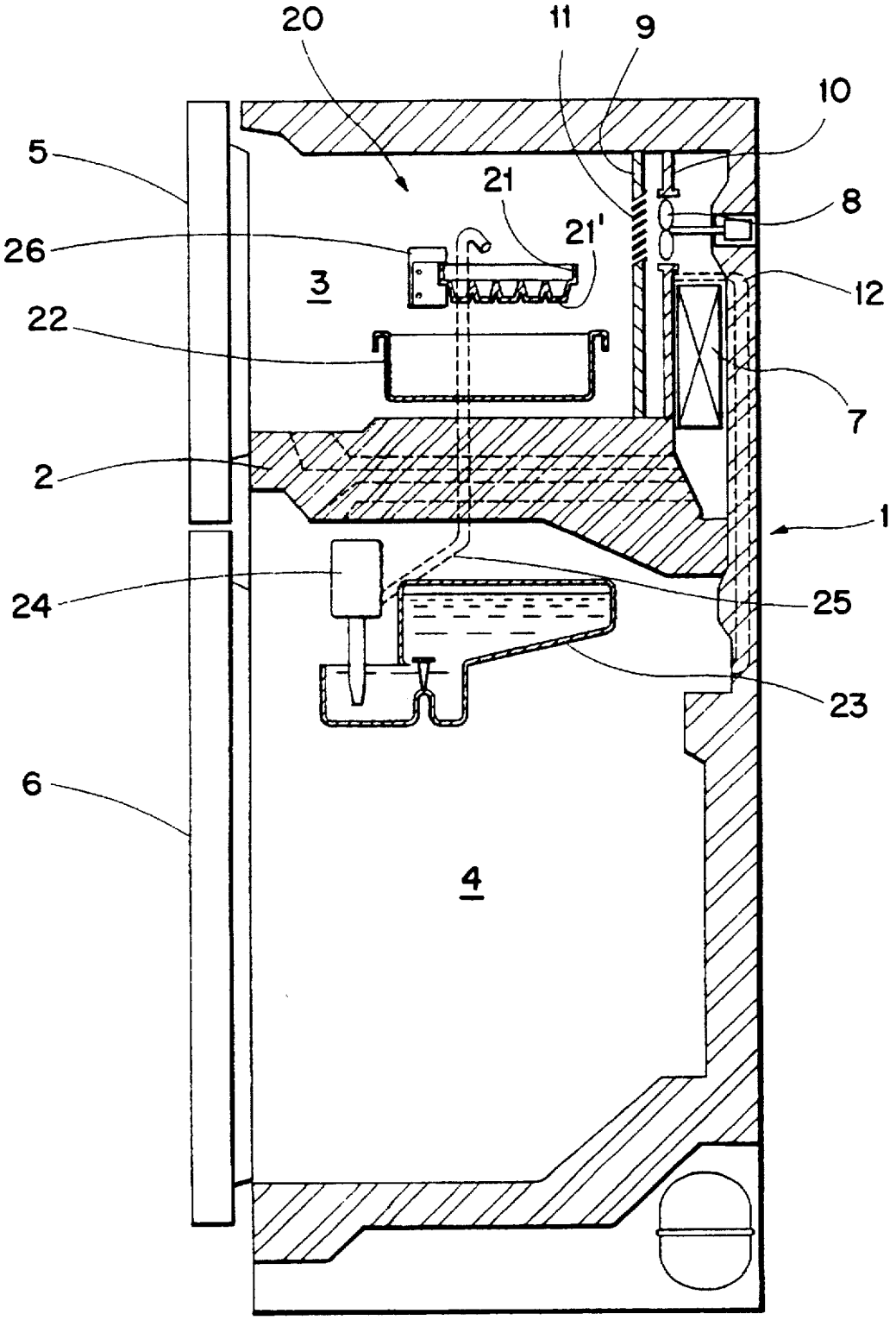
FIG. 5 (PRIOR ART)
FIG. 5 is a vertical cross-sectional view of a refrigerator adopting a conventional ice maker.
Figure 6:
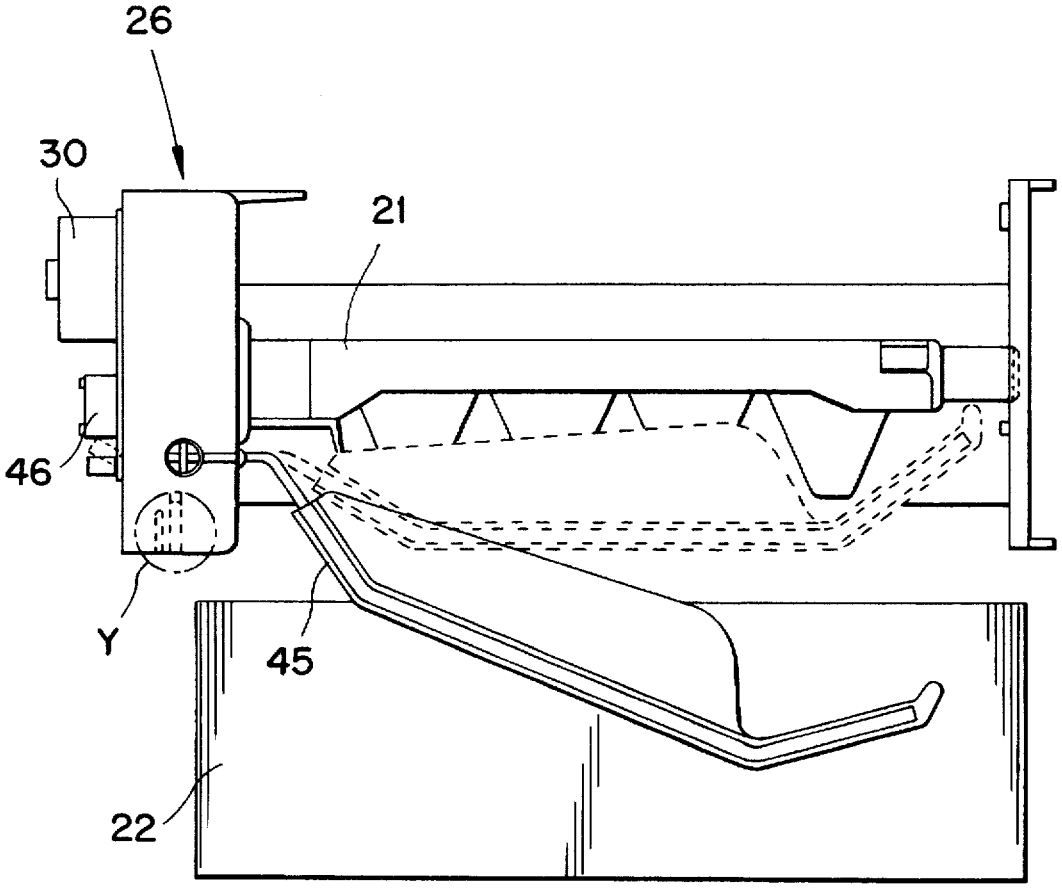
FIG. 6 (PRIOR ART)
FIG. 6 is an enlarged side view of the ice maker of FIG. 5.
Figure 7:
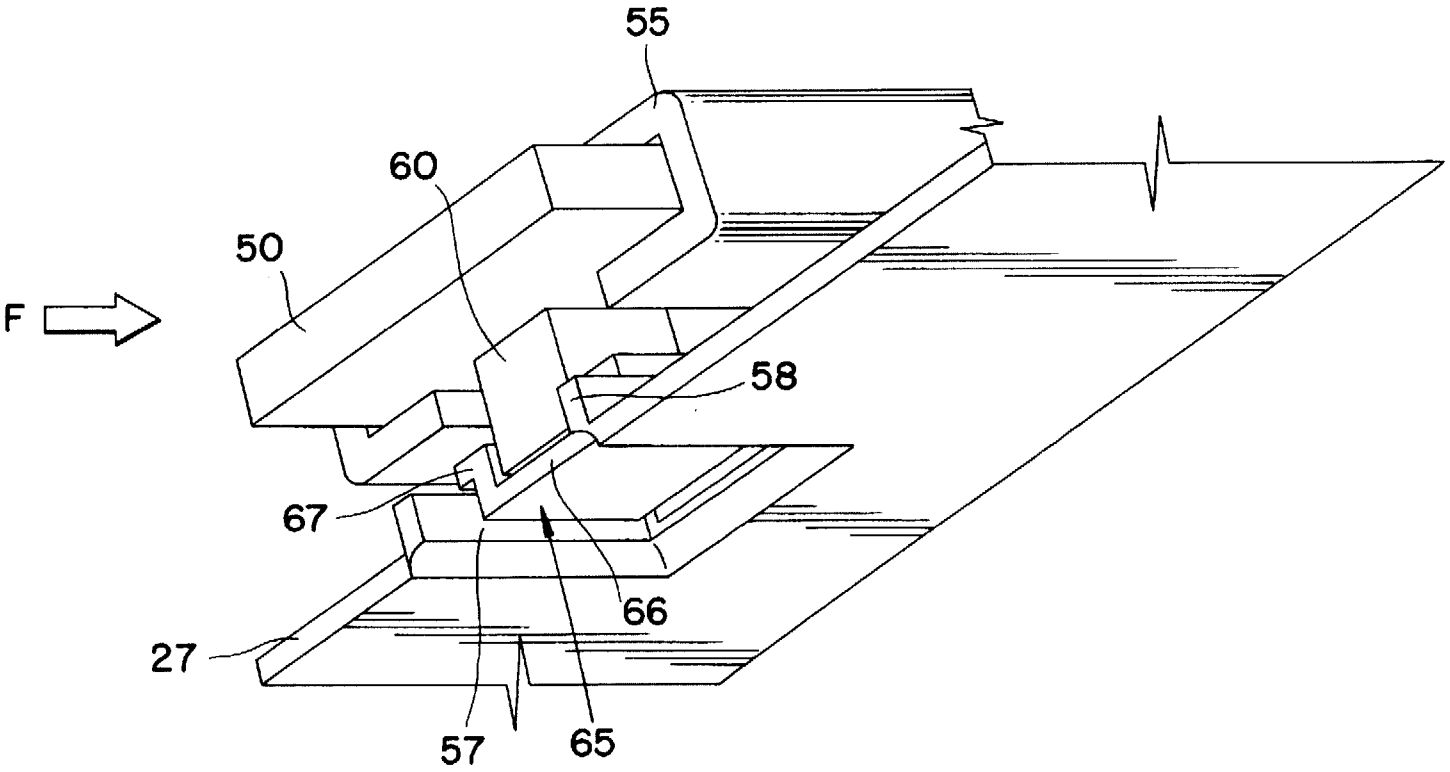
FIG. 7 (PRIOR ART)
FIG. 7 is an enlarged perspective view showing the portion of FIG. 6 disposed in the circle Y.
Figure 8:
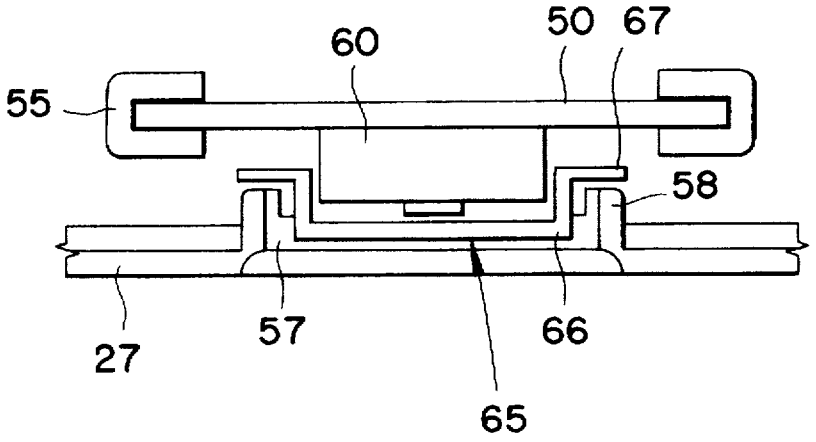
FIG. 8 (PRIOR ART)
FIG. 8 is a front view taken in the direction of arrow F of FIG. 7.

A button member 105 formed integrally with the case 71 is provided on the case 71 adjacent to the contact member 100 (See FIGS. 2–4). The rear end of the button member 105 is of one piece with the wall 71A of the case 71 and both sides 105A and the front end 105B of the button member are cut from the case 71. The front or free end of the button member 105 is biased toward the inside of the case 71 by a bias applied by the rear end or base 105C of the button member 105, and extends to the corresponding place beneath the contact member 100. The thickness of the button member 105 is smaller than that of the case 71 (See FIG. 3), which increases the elasticity of the button member 105. A nodule 106 is shaped on the button member 105 adjacent its free end 105B. When the nodule 106 of the button member 105 is pressed, the test switch 100 is operated, causing the control member (not shown) to make the motor 72 and the pump 24 operate sequentially. Therefore, the testing of the ice dropping mode and the water supply mode are executed.

Regarding the present invention's test switch of the ice maker, the button is integrally formed with the case, so there is no need for the installation of an additional button. A simple structure is attained and the assembly time is shortened. The biased button will always return to its initial position after being released. Since the biased button is partially cut from the case, there is no place to which the button and the test switch could be stuck due to frost; in no circumstance will the button become stuck to the case. These modifications, provide for a more stable operation.

What is claimed:

1. A refrigerator comprising:

a freezing compartment;

an ice maker housed in the freezing compartment and including a container in which water is converted to ice;

an operating member including a casing, a motor mounted in the casing for twisting the container for discharging the ice therefrom, and a manually operable test switch for activating the operating member to test its operability; the test switch including:

an electrical contact mounted inside the casing and including a projection, and a button for contacting the projection to activate the motor, the projection extending toward a wall of the casing, the button comprising a strip having two parallel sides and a front edge cut from the wall of the casing, and a base remaining integral with the wall, the front edge of the strip being of less thickness than the wall, the button being inherently biased to a position out of engagement with the contact, independently of a separate spring element, the button being elastically flexible so that a front portion of the button is engageable with the projection.

* * * * *